US009142165B2

(12) United States Patent
Huang et al.

(10) Patent No.: US 9,142,165 B2
(45) Date of Patent: Sep. 22, 2015

(54) FIELD SEQUENTIAL COLOR DISPLAY AND DRIVING METHOD THEREOF

(75) Inventors: Yu-Sheng Huang, Kaohsiung County (TW); Ya-Ling Hsu, Taipei County (TW); Hung-Lung Hou, Changhua County (TW)

(73) Assignee: Au Optronics Corporation, Hsinchu (TW)

( * ) Notice: Subject to any disclaimer, the term of this patent is extended or adjusted under 35 U.S.C. 154(b) by 1213 days.

(21) Appl. No.: 12/964,745

(22) Filed: Dec. 10, 2010

(65) Prior Publication Data

US 2012/0013526 A1 Jan. 19, 2012

(30) Foreign Application Priority Data

Jul. 19, 2010 (TW) ..... 99123637 A

(51) Int. Cl.
*G09G 3/36* (2006.01)
*G09G 3/34* (2006.01)

(52) U.S. Cl.
CPC ..... *G09G 3/3413* (2013.01); *G09G 3/3607* (2013.01); *G09G 2300/0452* (2013.01); *G09G 2310/0235* (2013.01)

(58) Field of Classification Search
CPC ..... G09G 3/3413; G09G 2310/0235
See application file for complete search history.

(56) References Cited

U.S. PATENT DOCUMENTS

2005/0225232 A1* 10/2005 Boroson et al. ..... 313/504
2007/0268429 A1* 11/2007 So ..... 349/106
2008/0158207 A1 7/2008 Weng et al.
2008/0165102 A1* 7/2008 Tsai et al. ..... 345/88
2009/0262148 A1* 10/2009 Kimura ..... 345/690

FOREIGN PATENT DOCUMENTS

TW 200600846 1/2006
TW 200828235 7/2008

OTHER PUBLICATIONS

"Office Action of Taiwan counterpart application" issued on Jul. 26, 2013, p. 1-p. 6.

* cited by examiner

*Primary Examiner* — Dennis Joseph
(74) *Attorney, Agent, or Firm* — Jianq Chyun IP Office

(57) ABSTRACT

A field sequential color display having a display panel and a backlight module is provided. The panel includes a plurality of unit regions, each having a first color unit region and a white color unit region. The panel includes a first substrate, a second substrate, a filter layer and a display medium. The first substrate has a pixel array. The second substrate is disposed opposite to the first substrate. The filter layer is disposed on the second substrate and has a first color filter pattern disposed within the first color unit regions and a white color filter pattern disposed within the white color unit regions. The display medium is between the first and second substrate. The backlight module is disposed at a side of the display panel and has a white light source, a second color light source and a third color light source which are switched in sequence.

11 Claims, 7 Drawing Sheets

FIELD SEQUENTIAL COLOR DISPLAY AND DRIVING METHOD THEREOF

CROSS-REFERENCE TO RELATED APPLICATION

This application claims the priority benefit of Taiwan application serial no. 99123637, filed on Jul. 19, 2010. The entirety of the above-mentioned patent application is hereby incorporated by reference herein and made a part of this specification.

BACKGROUND OF THE INVENTION

1. Field of the Present Invention

The present application generally relates to a display and its driving method. More particularly, the present application relates to a field sequential color display and its driving method.

2. Description of Related Art

Usually, an LCD panel includes a pixel array substrate, a color filter substrate, and a liquid crystal layer. The color filter substrate includes a color filter layer constructed from red, green, and blue photo resistor patterns, allowing the LCD panel to display images of full colors. Because the light from the backlight module must be filtered through the color filter layer, the utility rate of the light source in the backlight module is lower.

Currently, a field sequential color display is developed. The field sequential color display does not require using the color filter layer. The backlight module has red, green and blue light sources, switched in spatial. In other words, the field sequential color display quickly switches the red, green, and blue light sources, and the switch frequency is too faster to be perceived by the human sight. By utilizing the deficiencies in the human eye, the field sequential color display creates a color blending effect. However, since the red, green, and blue images are sequentially transmitted to the human eye, when the human eye shakes, or when the image moves, a color break-up is likely to happen. The color break-up would be improved by increasing the frame rate, however, the limitation of the response time of the liquid crystal molecules, it is not efficient in solving the color break-up phenomenon.

SUMMARY OF THE INVENTION

The invention provides a field sequential color display and a driving method thereof to be capable of resolving the color break-up phenomenon in field sequential color displays.

The invention provides a field sequential display, including a display panel and a backlight module. The display panel includes a plurality of unit regions, each unit region including a first color unit region and a white color unit region. The display panel includes a first substrate, a second substrate, a filter layer, and a display medium. The first substrate has a pixel array. The second substrate is located opposite to the first substrate. The filter layer is disposed on the second substrate, and has a first color filter pattern and a white color filter pattern. The first color filter pattern is disposed within the first color unit region, and the white color filter pattern is disposed within the white color unit region. The display medium is located between the first substrate and the second substrate. A backlight module is disposed on a side of the display panel. The backlight module includes a white light source, a second color light source, and a third color light source, wherein the white light source, the second color light source, and the third color light source are switched in sequence.

The invention also provides a driving method for driving the field sequential color display as above mentioned. The second color light source is switched to cause the light in the second light source passing through the white color unit region. The third color light source is switched to cause the light in the third light source passing through the white color unit region. The white light source is switched to cause the light in the white light source to pass through the white color unit region and the first color unit region.

In the field sequential color display of the invention, the first color filter pattern and the white color filter pattern are disposed in the display panel, and the white light source, the second color light source and the third color light source are disposed in the backlight module, wherein the white light source, the second color light source, and the third color light source are switched in sequence. This field sequential color display and the driving method thereof in the present invention can reduce the color break-up phenomenon without requiring increasing the frame rate.

It is to be understood that both the foregoing general descriptions and the following detailed embodiments are exemplary and are, together with the accompanying drawings, intended to provide further explanation of technical features and advantages of the present invention.

BRIEF DESCRIPTION OF THE DRAWINGS

The accompanying drawings are included to provide a further understanding of the present invention, and are incorporated in and constitute a part of this specification. The drawings illustrate embodiments of the present invention and, together with the description, serve to explain the principles of the present invention.

DESCRIPTION OF EMBODIMENTS

Figure 1:
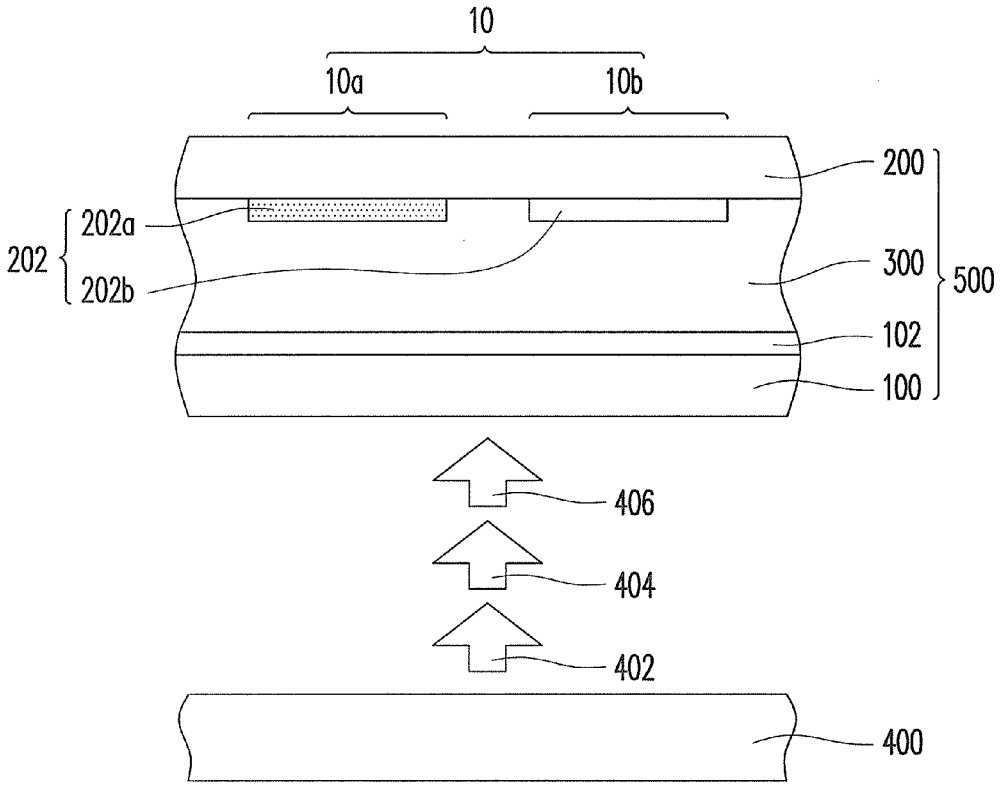
FIG. 1 is a cross-section view of a field sequential color display according to an embodiment of the present invention.
Figure 2:
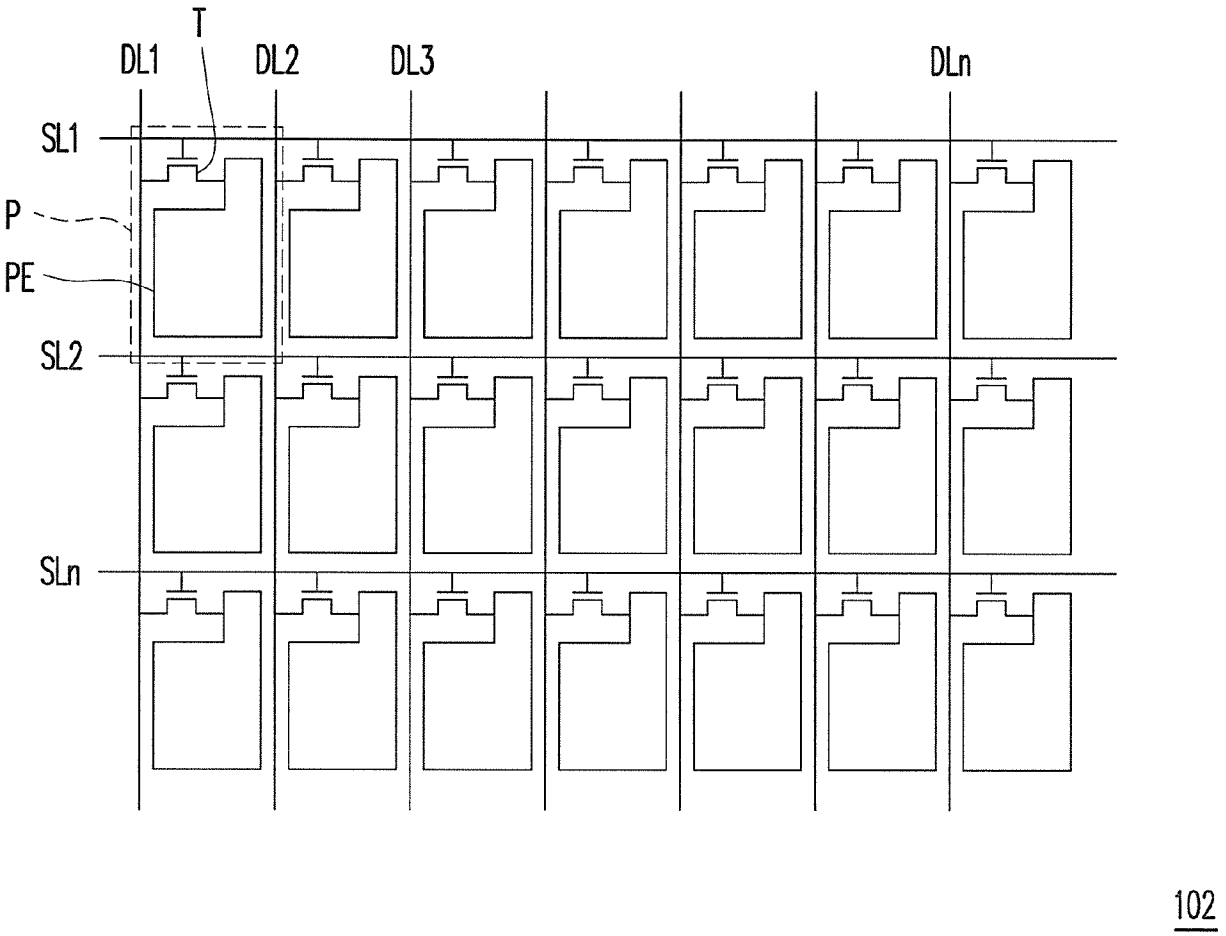
FIG. 2 is a schematic of a pixel array in the field sequential color display of FIG. 1.

FIG. 1 is a cross-section view of a field sequential color display according to an embodiment of the present invention. FIG. 2 is a schematic of the pixel array in the field sequential color display of FIG. 1. Please refer to FIG. 1, one embodiment of the field sequential display includes a display panel 500 and a backlight module 400.

The display panel 500 has a plurality of unit regions 10. FIG. 1 only shows and illustrates one of the unit regions 10 in the display panel. Each unit region 10 includes a first color unit region 10*a* and a white color unit region 10*b*. Also, the display panel 500 includes a first substrate 100, a second substrate 200, a filter layer 202, and a display medium 300.

The first substrate 100 has a pixel array 102 thereon. The pixel array includes scan lines SL1~SLn, data lines DL1~DLn, and pixel structures P. The scan lines SL1~SLn and the data lines DL1~DLn are disposed crossing over to each other. In other words, the extending direction of data lines DL1~DLn is not parallel to the extending direction of the scan lines SL1~SL2. Moreover, it is favorable for the extending direction of data lines DL1~DLn to be perpendicular to the extending direction of the scan lines SL1~SLn. In addition, the scan lines SL1~SLn and the data lines DL1~DLn are in different layers. Also, the scan lines SL1~SLn, and data lines DL1~DLn could be fabricated by metal for conductivity. However, the invention is not limited thereto. According to other embodiments, the scan lines SL1~SLn, and the data lines DL1~DLn can be fabricated by other conductive materials. Each pixel structure P includes an active device T and a pixel electrode PE, where pixel electrode PE is electrically connected to active device T. The active device T is an example of a bottom gate thin film transistor or a top gate thin film transistor, and comprises a gate, a channel, a source, and a drain.

According to the present embodiment, in the pixel array 102, every pixel structure P is disposed corresponding to a first color unit region 10*a* or a white color unit region 10*b*. In other words, every unit region 10 includes two pixel structures P. One of the pixel structures P corresponds to a first color filter pattern 202*a*, and the other pixel structure P corresponds to a white color filter pattern 202*b*.

The second substrate 200 is disposed opposite to the first substrate 100. The filter layer 202 is disposed on the second substrate 200. The filter layer 202 includes a first color filter pattern 202*a* and a white color filter pattern 202*b*. The first color filter pattern 202*a* is disposed within the first color unit region 10*a*, and the white color filter pattern 202*b* is disposed within the white color unit region 10*b*. The first color filter pattern 202*a* is a red color filter pattern, a blue color filter pattern, or a green color filter pattern. The white color filter pattern 202*b* within the white color unit region 10*b* is a transparent insulation material pattern, or part of the white color unit region 10*b* is not disposed to any material pattern and directly allows light to pass to the second substrate 200.

Also, according to one embodiment in the invention, in between the first color filter pattern 202*a* and the white color filter pattern 202*b* of the filter layer 202 is a gap that further includes a light-shielding pattern (not shown), also known as a black matrix. According to another embodiment, a layer of counter electrode layer (not shown) is further disposed on the filter layer 202, and the counter electrode layer is also known as a common electrode layer.

The display medium 300 is sandwiched between the first substrate 100 and the second substrate 200. According to the present embodiment, the display medium 300 comprises liquid crystal molecules.

The backlight module 400 is disposed on a side of the display panel 500, the backlight module 400 includes a white light source 402, a second color light source 404, and a third color light source 406, wherein the white light source 402, the second color light source 404, and the third color light source 406 are switched in sequence. In further detail, the white light source 402, the second color light source 404, and the third color light source 406 of the backlight module 400 is sequentially emitted. This means, at one time period, only one light source of the white light source 402, the second color light source 404, and the third color light source 406 is turned-on, and the other two light sources are turned-off. The white light source 402, the second color light source 404, and the third color light source 406 may utilize LED light sources or any other suitable light sources.

The color in the first color filter pattern 202*a* of filter layer 202, and the colors in the second color light source 404 and the third color light source 406 in the backlight module 400 will be used to discuss the driving method of the field sequential color display.

Figure 3:
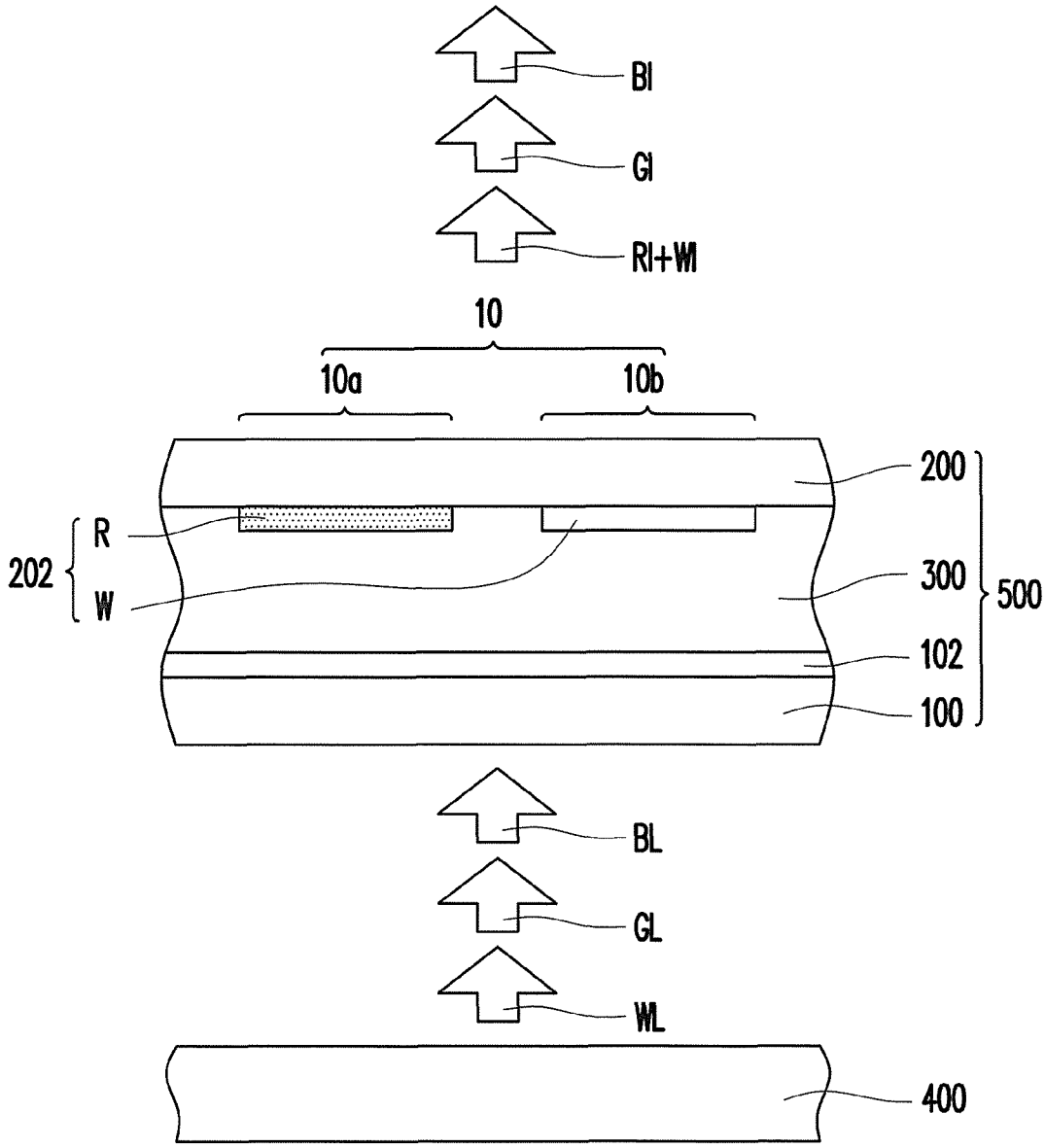
FIG. 3 is a schematic of the field sequential color display and the driving method thereof according to an embodiment of the present invention.

FIG. 3 is a schematic of the field sequential color display and the driving method according to an embodiment of the present invention. For the embodiment in FIG. 3, the first color filter pattern R in the filter layer 202 is a red color filter pattern. As a result, the first color unit region 10*a* is a red color unit region. The second color light source GL in the backlight module 400 is a green color light source, and the third color light source BL is a blue color light source. In other words, in the embodiment of FIG. 3, the filter layer 202 includes a red color filter pattern R and a white color filter pattern W. The backlight module 400 has a white light source WL, a green color light source GL, and a blue color light source BL. The white light source WL, the green color light source GL, and the blue color light source BL are switched in sequence.

For the embodiment in FIG. 3, when the blue color light source BL in the backlight module 400 is turned-on, the green color light source GL and the white light source WL are turned off. When the green color light source GL in the backlight module 400 is turned-on, the white light source WL and the blue color light source BL are turned off. When the white light source WL in the backlight module 400 is turned-on, the green color light source GL and the blue color light source BL are turned off.

According to the embodiment in FIG. 3, when the blue color light source BL in the backlight module 400 is turned-on, the light of the blue color light source BL passes through the white color filter pattern W in the white color unit region 10*b*. However, the light of the blue color light source BL will not be able to pass through the red color filter pattern R in the red color unit region 10*a*. Thus, at this time, the display panel displays a blue light image BI.

When the green color light source GL in the backlight module 400 is turned-on, the light of the green color light source GL passes through the white color filter pattern W in the white color unit region 10*b*. However, the light of the green color light source GL will not be able to pass through the red color filter pattern R in the red color unit region 10*a*. Thus, at this time, the display panel displays a green light image GI.

When turning on the white light source WL in the backlight module 400, the light of the white light source WL passes through the white color filter pattern W in the white color unit region 10*b* and the red color filter pattern R in the red color unit region 10*a*. Thus, at this time, the display panel simultaneously displays a red light image RI and a white light image WI.

Since the blue color light source BL, the green color light source GL, and the white light source WL in the backlight module 400 are swiftly switched in sequence, the blue light image BI, the green light image GI, and the red light image RI and white light image WI are sequentially transmitted to the human eye. Because of color-mixing, making from the persistence of vision, human can see a full color display image.

Figure 4:
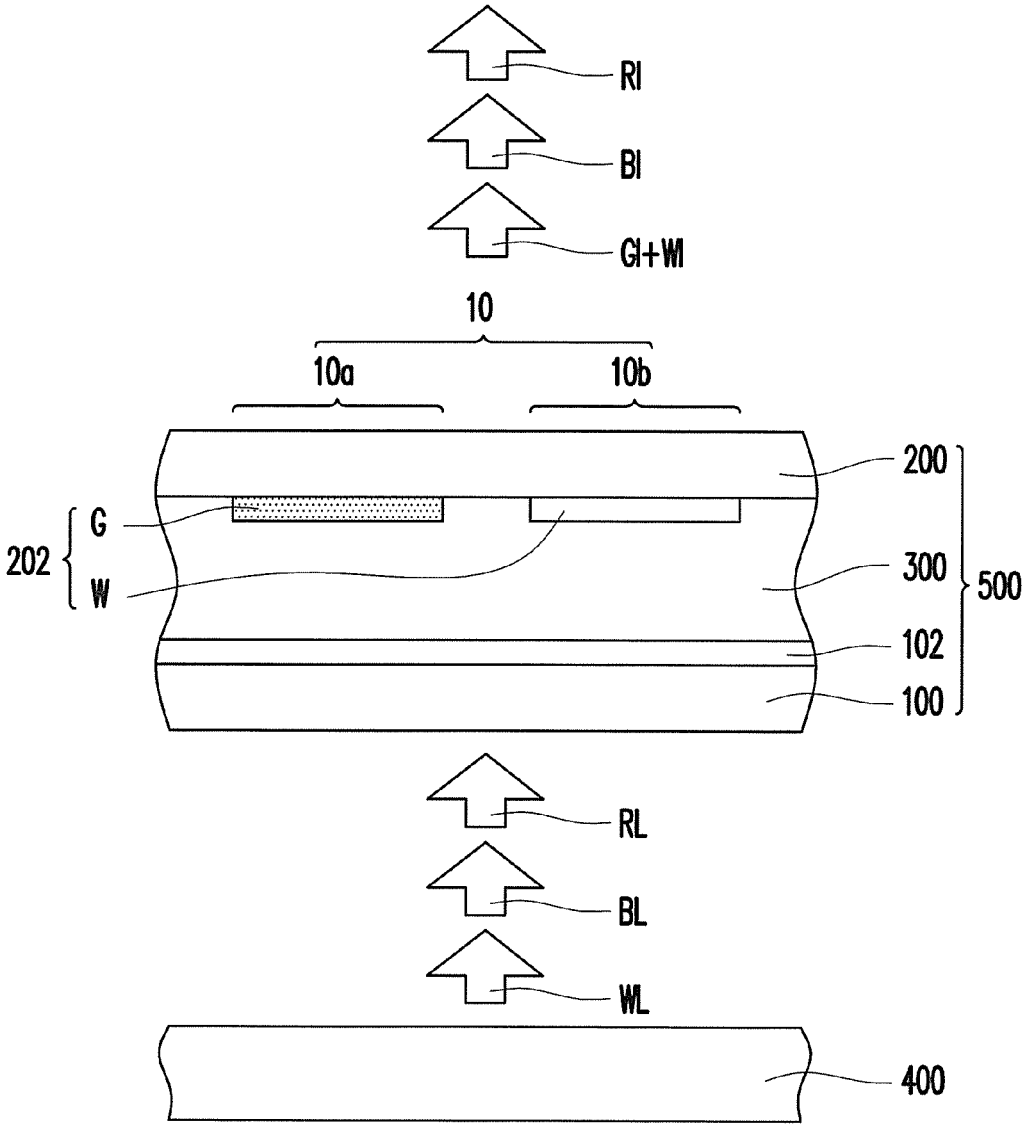
FIG. 4 is a schematic of the field sequential color display and the driving method according to another embodiment of the present invention.

FIG. 4 is a schematic of the field sequential color display and the driving method according to an embodiment of the present invention. For the embodiment in FIG. 4, the first color filter pattern G in the filter layer 202 is a green color filter pattern. As a result, the first color unit region 10*a* is a green color unit region. In the backlight module 400, the second color light source BL is a blue color light source and the third color light source RL is a red color light source. In other words, in the embodiment of FIG. 4, the filter layer 202 includes a green color filter pattern G and a white color filter pattern W. The backlight module 400 has a white light source WL, a blue color light source BL, and a red color light source RL. The white light source WL, the blue color light source BL, and the red color light source RL are switched in sequence.

According to the embodiment in FIG. 4, when turning on the red color light source RL in the backlight module 400, the light of the red color light source RL passes through the white color filter pattern W in the white color unit region 10*b*. However, the light of the red color light source RL will not be able to pass through the green color filter pattern G in the green color unit region 10*a*. Thus, at this time, the display panel displays a red light image RI.

When turning on the blue color light source BL in the backlight module 400, the light of the blue color light source BL passes through the white color filter pattern W in the white color unit region 10*b*. However, the light of the blue color light source BL will not be able to pass through the green color filter pattern G in the green color unit region 10*a*. Thus, at this time, the display panel displays a blue light image BI.

When turning on the white light source WL in the backlight module 400, the light of the white light source WL passes through the white color filter pattern W in the white color unit region 10*b* and the green color filter pattern G in the green color unit region 10*a*. Thus, at this time, the display panel simultaneously displays a green light image GI and a white light image WI.

Since the red color light source RL, the blue color light source BL, and the white light source WL in the backlight module 400 are swiftly switched in sequence, the red light image RI, the blue light image BI, and the green light image GI and white light image WI are sequentially transmitted to the human eye. Because of color-mixing, making from the persistence of vision, human can sees a full color display image.

Figure 5:
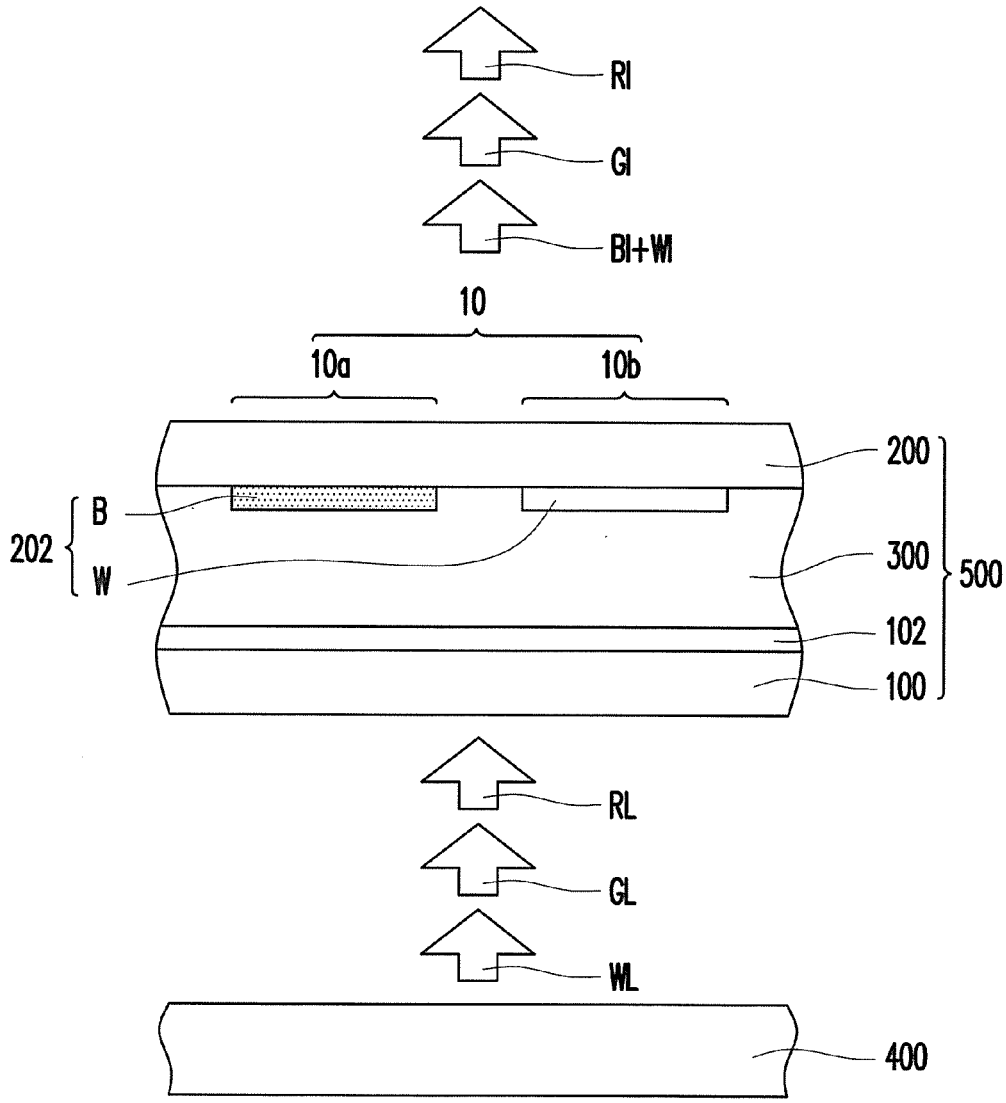
FIG. 5 is a schematic of the field sequential color display and the driving method according to yet another embodiment of the present invention.

FIG. 5 is a schematic of the field sequential color display and the driving method according to an embodiment of the present invention. For the embodiment in FIG. 5, the first color filter pattern B in the filter layer 202 is a blue color filter pattern. As a result, the first color unit region 10*a* is a blue color unit region. The second color light source GL in the backlight module 400 is a green color light source, and the third color light source RL is a red color light source. In other words, in the embodiment of FIG. 5, the filter layer 202 includes a blue color filter pattern B and a white color filter pattern W. The backlight module 400 has a white light source WL, a green color light source GL, and a red color light source RL. The white light source WL, the green color light source GL, and the red color light source RL are switched in sequence.

According to the embodiment in FIG. 5, when turning on the red color light source RL in the backlight module 400, the light of the red color light source RL passes through the white color filter pattern W in the white color unit region 10*b*. However, the light of the red color light source RL will not be able to pass through the blue color filter pattern B in the blue color unit region 10*a*. Thus, at this time, the display panel displays a red light image RI.

When turning on the green color light source GL in the backlight module 400, the light of the green color light source GL passes through the white color filter pattern W in the white color unit region 10*b*. However, the light of the green color light source GL will not be able to pass through the blue color filter pattern B in the blue color unit region 10*a*. Thus, at this time, the display panel displays a green light image GI.

When turning on the white light source WL in the backlight module 400, the light of the white light source WL passes through the white color filter pattern W in the white color unit region 10*b* and the blue color filter pattern B in the blue color unit region 10*a*. Thus, at this time, the display panel simultaneously displays a blue light image BI and a white light image WI.

Since the red color light source RL, the green color light source GL, and the white light source WL in the backlight module 400 are swiftly switched in sequence, the red light image RI, the green light image GI, and the blue light image BI and white light image WI are sequentially transmitted to the human eye. Because of color-mixing, making from the persistence of vision, human can see a full color display image.

In the above embodiments, the first color filter pattern and the white color filter pattern are disposed in the display panel. Furthermore, the second color light source and the third color light source are disposed in the backlight module. This type of design method provides the reduction of the color break-up phenomenon without requiring increasing the frame rate. For example, when the frequency of the frame rate is 180 Hz, a conventional frame rate, will have color break-up. When the frame rate is raised to 240 Hz, it effectively reduces the color break-up. However, when the frame rate is raised to 240 Hz, it will bring a new issue cause from the slow response time of the liquid crystal molecules. However, in the present invention of the field sequential color display, it can effectively solve the color break-up issue when operated at the conventional frame rate, 180 Hz. The display quality is much better than that raising the frame rate up to 240 Hz in the conventional display.

Also, for the invention of the field sequential color display, the area of the first color unit region 10*a* in the unit region 10 and the area of the white color unit region 10*b* are allowed to be the same or different. For the embodiments in FIG. 1 and FIG. 3 to FIG. 5, the area of the first color unit region 10*a* and the area of the white color unit region 10*b* are the same. Meaning the ratio of the area of the first color unit region 10*a* and the area of the white color unit region 10*b* is 1:1. According to the other embodiments in the invention, the area of the first color unit region 10*a* and the area of the white color unit region 10*b* are allowed to be different. Thus, the ratio between the area of the first color unit region 10*a* and the area of the white color unit region 10*b* can be 0.5:1~1:1.

Figure 6:
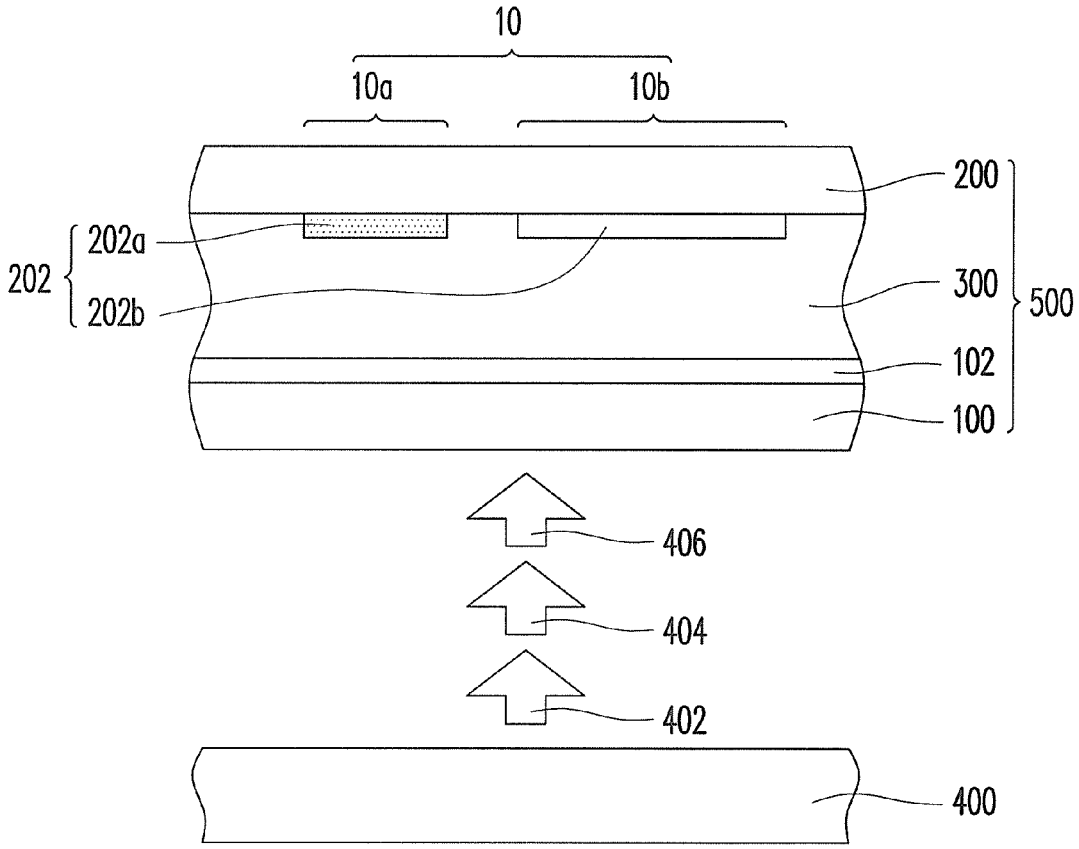
FIG. 6 is a cross-section view of a field sequential color display according to an embodiment of the present invention.

FIG. 6 is a cross-section view of a field sequential color display according to an embodiment of the present invention. The embodiment in FIG. 6 and the embodiment in FIG. 1 are similar, so similar components and similar represented symbols are not repeated hereinafter. The difference between the embodiment of FIG. 6 and the embodiment of FIG. 1 is that the area of the first color unit region 10*a* (the first color filter pattern 202*a*) and the area of the white color unit region 10*b* (the white color filter pattern 202*b*) are different. According to the present embodiment, the area of the first color unit region 10*a* (the first color filter pattern 202*a*) is smaller than the area of the white color unit region 10*b* (the white color filter pattern 202*b*).

Generally, the first color unit region 10*a* (the first color filter pattern 202*a*) has a lower transmittance. The entire brightness of the field sequential color display can be improved by decreasing the area of the first color unit region 10*a* (the first color filter pattern 202*a*). Also, when the area of the first color unit region 10*a* (the first color filter pattern 202*a*) is reduced, in order to maintain the brightness of the red light image, green light image, and blue light image, the brightness of the white light source is increased, or the amount of the white light source is increased.

As mentioned, if the amount of white light source is increased in the backlight module, the amount of second color light source and third color light source in the backlight module will be reduced. Because of the lower price of white light LED, it will also reduce the overall cost by reducing the amount of the second color light source and third color light source, another side effect of the present invention.

Figure 7:
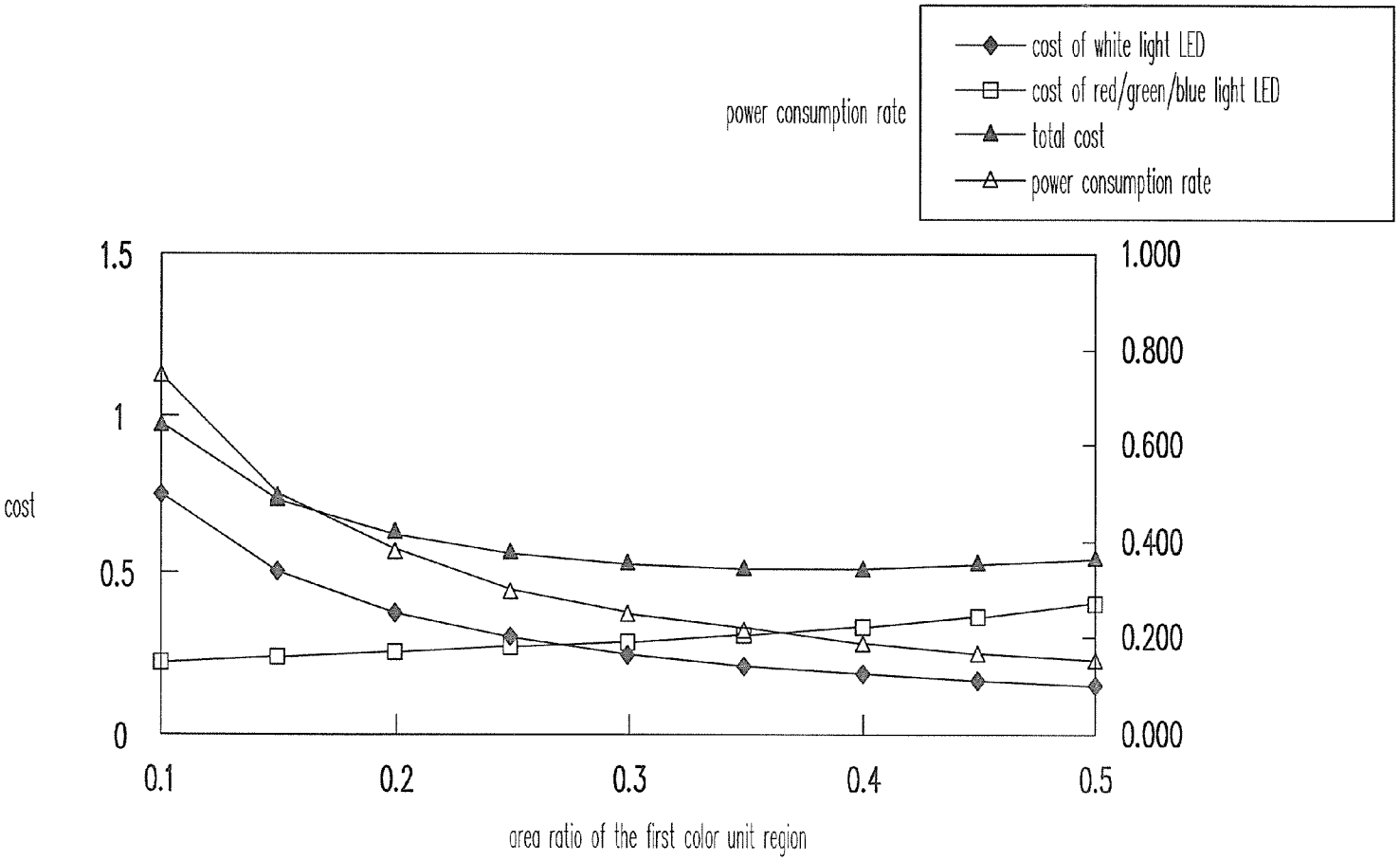
FIG. 7 is a diagram showing the first color unit region area ratio, the cost, and the power consumption rate of the field sequential color display according to an embodiment of the present invention.

FIG. 7 is a diagram showing the first color unit region area ratio, the cost, and the power consumption rate of the field sequential color display according to an embodiment of the present invention. Please refer to FIG. 7, the x-axis represents the area ratio of the first color unit region (the first color filter pattern). The left y-axis represents the cost of the light source, and the right y-axis represents the power consumption rate.

When considering the conditions of a lower power consumption rate, it is favorable for the area of the first color unit region (the first color filter pattern) to occupy 50% of the unit region area. Meaning, the area of the first color unit region 10*a* (the first color filter pattern 202*a*) is the same to the area of the white color unit region 10*b* (the white color filter pattern 202*b*) (1:1).

When considering the conditions of a lower light source cost, it is favorable for the area of the first color unit region (the first color filter pattern) to occupy 40% of the unit region area. Meaning, the area of the first color unit region 10*a* (the first color filter pattern 202*a*) is smaller than the area of the white color unit region 10*b* (the white color filter pattern 202*b*). The ratio is about 4:6. FIG. 7 is only one embodiment of the present invention. Based on different light source costs, there are different area ratios. Anyone skilled in the art can design different area ratios based on the present invention. The present invention is not limited hereby.

To sum up, the first color filter pattern and the white color filter pattern are disposed in the display panel, and the white light source, the second color light source and the third color light source are disposed in the backlight module. The white light source, the second color light source, and the third color light source are switched in sequence. In present invention, the color break-up phenomenon will be solved without changing the frame rate, so that the display quality will be promoted; the power consumption and/or overall cost will be decease by adapting the area ratio of the first color filter pattern and the white color filter pattern. In other words, if the area of the first color unit region (the first color filter pattern) is designed as smaller than the area of the white color unit region (the white color filter pattern), not only aiding the field sequential color display improving the overall brightness but also reducing the overall cost.

It will be apparent to those skilled in the art that various modifications and variations can be made to the structure of the present invention without departing from the scope or spirit of the present invention. In view of the foregoing, it is intended that the present invention cover modifications and variations of the present invention provided they fall within the scope of the following claims and their equivalents.

What is claimed is:

1. A field sequential color display, comprising;

a display panel including a plurality of unit regions, each unit region including a first color unit region and a white color unit region, the display panel comprising:

a first substrate comprising a pixel array;

a second substrate disposed opposite to the first substrate;

a filter layer disposed on the second substrate, wherein the filter layer is consisted of only a first color filter pattern disposed within the first color unit region and a white color filter pattern disposed within the white color unit region;

wherein the area of the first color region and the area of the white color region state a ratio of 4:6;

a display medium, sandwiched between the first substrate and the second substrate; and a backlight module, disposed on a side of the display panel, the backlight module comprising of a white light source, a second color light source, and a third color light source, the white light source, the second color light source, and the third color light source are configured to be switched in sequence, wherein:

the white light source is configured to provide a white light separating into a first white light portion and a second white light portion, the first white light portion passes through the white color unit, the second white light portion passes through the first color filter pattern and transformed into a color of the first color filter pattern;

the second color light source is configured to provide a second color light separating into a first second-color-light portion and a second second-color-light portion, the first second-color-light portion passes through the white color unit, and the second second-color-light portion is blocked by the first color filter pattern; and the third color light source is configured to provide a third color light separating into a first third-color-light portion and a second third-color-light portion, the first third-color-light portion passes through the white color unit, and the second third-color-light portion is blocked by the first color filter pattern.

2. The field sequential color display as claimed in claim 1, where:

the filter layer is consisted of only a first color filter pattern and a white color filter pattern, and the first color filter pattern is a red color filter pattern;

the second color light source is a green color light source; and the third color light source is a blue color light source.

3. The field sequential color display as claimed in claim 1, where:

the first color filter pattern is a green color filter pattern;

the second color light source is a blue color light source; and the third color light source is a red color light source.

4. The field sequential color display as claimed in claim 1, where:

the first color filter pattern is a blue color filter pattern;

the second color light source is a green color light source; and the third color light source is a red color light source.

5. The field sequential color display as claimed in claim 1, wherein the area of the first color unit region and the area of the white color unit region state a ratio greater than or equal to 0.5:1 and lower than 1:1.

6. The field sequential color display as claimed in claim 5, wherein the area of the first color unit region and the area of the white color unit region state a ratio of 4:6.

7. A driving method for driving the field sequential color display panel as claimed in claim 1, the driving method comprising:

switching the second color light source, causing the light in the second light source to pass through the white color unit region;

switching the third color light source, causing the light in the third light source to pass through the white color unit region; and switching the white light source, causing the light in the white light source to pass through the white color unit region and the first color unit region.

8. The field sequential color display driving method as claimed in claim 7, where:

the first color filter pattern is a red color filter pattern;

the second color light source is a green color light source; and the third color light source is a blue color light source.

9. The field sequential color display driving method as claimed in claim 7, where:

the first color filter pattern is a green color filter pattern;

the second color light source is a blue color light source; and the third color light source is a red color light source.

10. The field sequential color display driving method as claimed in claim 7, where:

the first color filter pattern is a blue color filter pattern;

the second color light source is a green color light source; and the third color light source is a red color light source.

11. The field sequential color display driving method as claimed in claim 7, wherein the white light source, the second color light source, and the third color light source are switched in sequence.

* * * * *